United States Patent [19]

Isogai et al.

[11] 4,300,519

[45] Nov. 17, 1981

[54] IGNITION COIL DEVICE ATTACHING CONSTRUCTION

[75] Inventors: Kiyoshi Isogai, Toyota; Kazuyoshi Sugaya, Kariya, both of Japan

[73] Assignee: Toyota Jidosha Kogyo Kabushiki Kaisha, Aichi, Japan

[21] Appl. No.: 153,524

[22] Filed: May 27, 1980

[30] Foreign Application Priority Data

Jun. 29, 1979 [JP] Japan ..... 54-90335[U]

[51] Int. Cl.[3] ..... F02B 77/00

[52] U.S. Cl. ..... 123/647; 123/635

[58] Field of Search ..... 123/634, 635, 647, 195 A

[56] References Cited

U.S. PATENT DOCUMENTS 1,598,486 8/1926 Mallory ..... 123/634

4,099,510 7/1978 Perrier ..... 123/634

4,195,611 4/1980 Worz ..... 123/634

*Primary Examiner*—Ronald B. Cox

*Attorney, Agent, or Firm*—Stevens, Davis, Miller & Mosher

[57] ABSTRACT

An attaching construction for attaching an ignition coil device to the external surface of an internal combustion engine, in which a coil side bracket is mounted to the ignition coil device, an engine side bracket is mounted to the external surface of the internal combustion engine, and a layer, formed of a resilient rubber-like elastomer with low heat conductivity and high temperature resistance, is provided to extend between the coil side bracket and the engine side bracket, so as to join them, and thereby to mount the ignition coil device to the internal combustion engine.

9 Claims, 1 Drawing Figure

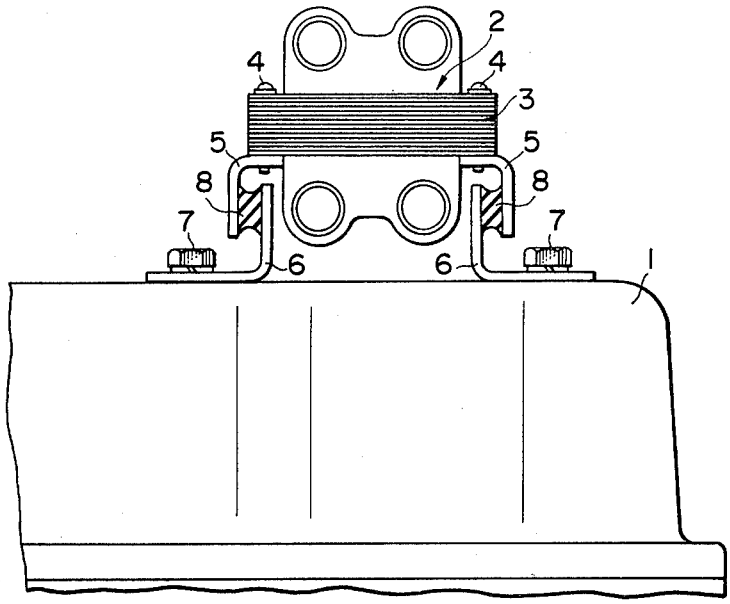
2
4
4
3
5
5
8
8
7
7
6
6
1

IGNITION COIL DEVICE ATTACHING CONSTRUCTION

BACKGROUND OF THE INVENTION

The present invention relates to an ignition coil device attaching construction for attaching an ignition coil device to an internal combustion engine, and, more particularly, relates to such an ignition coil device attaching construction which fixes the ignition coil device securely to the internal combustion engine, while at the same time to a certain extent isolating it from the damaging effects of shock, vibration, and heat conduction from the internal combustion engine, and which further prevents the ignition coil device from disturbing the functioning of the engine or of various electrical or electronic accessories attached to the engine by leakage of high tension electricity.

In general, in automobiles or other vehicles incorporating internal combustion engines with ignition systems, it is known and practiced to attach the ignition coil device of the ignition system to a bulkhead or other body member, inside the engine compartment of the vehicle. This is usually done in order to mount the ignition coil device where it will not be substantially damaged or affected by vibration produced by the internal combustion engine of the vehicle, or by heat conducted therefrom, and where it will not disturb the engine by leakage of high tension electricity, while at the same time being near enough to the internal combustion engine to be easily connected to a distributor thereof, for providing electricity for sparking the spark plugs of the engine. However, in some cases, it has been practiced to mount such an ignition coil device to the internal combustion engine exterior surface, directly, in view of considerations regarding available space, and convenience of connecting electrical wiring, both to the primary circuit of the ignition coil device, and to the secondary or high tension circuit of the ignition coil device which produces high voltage electricity for sparking the spark plugs. In this case, it is necessary that the ignition coil device should be mounted to the outer surface of the internal combustion engine without receiving undue vibration or conducted heat from the internal combustion engine, or otherwise it may be damaged thereby, and thus will not maintain its proper life span or durability, and may suffer deterioration in its electrical performance. Further, if any leakage of high tension electricity from the ignition coil device occurs to the body of the internal combustion engine, it may disturb operation of the internal combustion engine, or of various electrical or electronic components or accessories of the internal combustion engine, such as a transistorized primary circuit for the ignition timing, a transistorized or computerized fuel injection system for injection of fuel into the cylinders of the engine, a computerized fault finding system for the engine, or the like. Such leakage of high tension electricity may even, in extreme cases, create a severe fire hazard.

SUMMARY OF THE INVENTION

From consideration of such circumstances as outlined above, one of the objects of the present invention is to provide a simple and cheap ignition coil device attaching construction for attaching such an ignition coil device to the outer surface of an internal combustion engine, which mounts the ignition coil device in an anti-vibration manner, so as to absorb vibrations of the internal combustion engine, and so as to prevent these vibrations from being transmitted to the ignition coil device.

Another object of the present invention is to provide such an ignition coil device attaching construction for attaching the ignition coil device to the internal combustion engine, which at the same time prevents to a certain extent, as much as possible, transmission of heat by heat conduction from the internal combustion engine to the ignition coil device.

Yet another object of the present invention is to provide such an ignition coil device attaching construction which attaches an ignition coil device to the outer surface of an internal combustion engine, while maintaining electrical insulation between these two parts, thus preventing leakage of high voltage electricity from the ignition coil to the body of the internal combustion engine.

According to the present invention, these, and other, objects are attained by an ignition coil device attaching construction for attaching an ignition coil device to the external surface of an internal combustion engine, comprising a first coil side bracket mounted to the ignition coil device, a second engine side bracket mounted to said external surface of the engine, and a layer extending between said first coil side bracket and said second engine side bracket and connecting them and formed of a resilient elastomer with low heat conductivity and high temperature resistance.

By this simple, cheap, and easy to make construction, therefore, the ignition coil device may be mounted in a heat insulating, anti-vibration, and electrically insulating manner. Thereby, long life of the ignition coil is promoted, and reliable operation thereof, as well as of other electric and/or electronic components or accessories mounted to the internal combustion engine, is promoted.

BRIEF DESCRIPTION OF THE DRAWING

The present invention will become more fully understood from the following description of a preferred embodiment thereof, which is to be taken in conjunction with the accompanying drawing. It should be clearly understood, however, that the description of the embodiment, and the drawing, are all of them provided purely for the purposes of illustration and exemplification only, and are in no way to be taken as limitative of the scope of the present invention. In the drawing:

The sole FIGURE is a side view of a preferred embodiment of an ignition coil device attaching construction according to the present invention, shown as attaching an ignition coil device to the cylinder head rocker box cover of an internal combustion engine.

DESCRIPTION OF THE PREFERRED EMBODIMENT

The present invention will now be described more specifically with reference to a preferred embodiment thereof.

Referring to the drawing, there is shown a partial side view of a cylinder head rocker box cover of an internal combustion engine, designated by reference numeral 1, and an ignition coil device, designated by reference numeral 2. This ignition coil device 2 is constructed, in this embodiment, with a multi layered ignition coil device ferrous core 3, which is formed of a plurality of thin layers of ferrous material, said layers being clamped together with a plurality of core assembling screws 4. These core assembling screws 4 have dual use, in that they also serve to clamp the one ends of two L-shaped coil attaching brackets 5 to the multi layered ignition coil device ferrous core 3. Thus, these L-shaped coil attaching brackets 5 are directly fixed to the multi layered ignition coil device ferrous core 3.

To the upper surface of the cylinder head rocker box cover 1, further, are mounted the one ends of two L-shaped engine brackets 6, using engine bracket fixing bolts 7. The other ends of these L-shaped engine brackets 6 extend upwards in the drawing, and are located in between the other ends of said L-shaped coil attaching brackets 5, which oppose said other ends of the L-shaped engine brackets 6 generally on their outsides at a certain distance.

Between said other ends of the L-shaped coil attaching brackets 5 and said other ends of the L-shaped engine brackets 6, across said gaps, there are provided two heat insulating anti-vibration layers 8, which are formed of a rubber-like elastomer material. Thus, each of these heat insulation anti-vibration layers 8 connects one of the L-shaped coil attaching brackets 5 to one of the L-shaped engine brackets 6.

These heat insulating anti-vibration layers 8 are constructed from a rubber-like elastomer material, which has good resistance to high temperatures, and is not damaged thereby. This material may be, for example, butadiene rubber, styrene butadiene rubber, acrylonitrile butadiene rubber, isobutylene isoprene rubber, ethylene propylene rubber, or other similar materials. All of these materials, in fact, are also, substantially, electrical insulators. Further, they have a good affinity to, and a good attaching characteristic to, metal, which is a preferred material for the brackets 5 and 6.

Therefore, since the ignition coil device 2 is thereby elastically mounted onto the cylinder head rocker box cover 1, via the heat insulating anti-vibration layers 8, the vibrations produced by the internal combustion engine are effectively prevented from being transmitted, in their full force, to the ignition coil device 2, by elastic deformation and hysteresis in the heat insulating anti-vibration layers 8. Thereby, damage to the ignition coil device 2 caused by excessive vibration produced by the internal combustion engine may be effectively prevented.

Further, the heat insulating anti-vibration layers 8 also act, because of their low heat conductivity, to shield and prevent against the transfer of heat between the L-shaped engine bracket 6 and the L-shaped coil attaching bracket 5, i.e. between the internal combustion engine and the ignition coil device 2. By this prevention or hindering of conduction of heat to the ignition coil device 2, damage to this ignition coil device 2 due to excessive heat conducted from the internal combustion engine, also, can be effectively avoided.

Furthermore, because the characteristic materials described above for the construction of the heat insulating anti-vibration layers 8 are electrically substantially insulating, electrical insulation is maintained between the L-shaped coil attaching brackets 5 and the L-shaped engine brackets 6, and thus between the internal combustion engine and the ignition coil device 2, thus preventing any leakage of high tension electricity from the ignition coil device 2 to the internal combustion engine. This, therefore, provides a good electrical performance for the ignition coil device 2, and protects the engine, or any electrical or electronic components or accessories of the engine, from being damaged by such leakage, or from being disturbed in their functioning.

Therefore, in summary, according to the present invention as described above with reference to an embodiment, since the ignition coil device is mounted on the internal combustion engine via a heat insulating anti-vibration layer constructed of rubber-like elastomer, thereby the ignition coil device may be mounted in such a way that it is protected against vibration caused by the internal combustion engine, against heat generated by the internal combustion engine, and further so that it does not disturb the functioning of the internal combustion engine or the electrical devices or accessories attached thereto by leakage of high tension electricity, at one and the same time.

It should be understood that although the shown embodiment has described an ignition coil device attaching construction formed with two heat insulating anti-vibration layers 8, which are secured between two outer brackets which are attached to the ignition coil device, and two inner brackets which are attached to the cylinder head rocker box cover 1, this is not essential to the present invention, which merely requires that at least one such heat insulating anti-vibration layer should be provided between at least one coil attaching bracket attached to the ignition coil device, and at least one engine bracket attached to the external surface of an internal combustion engine.

Further, although the materials suggested for the construction of the heat insulating anti-vibration layer or layers 8 are preferred, they are not intended to be taken as exclusive of other possibilities.

Further, although it is useful and advantageous for the core assembly screws 4 to have the dual functions of securing together the layers of the multi layered ignition coil device ferrous core 3, and attaching the L-shaped coil attaching brackets 5 to this ferrous core 3, this is not essential to the present invention, but is a useful specialization thereof.

Therefore, although the present invention has been shown and described in terms of a preferred embodiment thereof, and in language more or less specific with regard to structural features thereof, and with reference to the illustrative drawing, it should be understood that in this embodiment of the present invention various changes, modifications, and omissions of the form and the detail thereof can be made by a person skilled in the art, without departing from the essential scope of the invention. Therefore, it is expressly desired that the scope of the present invention should be uniquely delimited by the legitimate and valid scope of the appended claims, which follow, and not by any of the perhaps purely fortuitous details of the shown embodiment, or of the drawing.

We claim:

1. An attaching construction for attaching an ignition coil device to the external surface of an internal combustion engine, comprising:

a first L-shaped coil side bracket having one end connected to the ignition coil device, a second L-shaped engine side bracket having one end connected to said external surface of the engine, a third L-shaped coil side bracket having one end connected to said ignition coil device, and a fourth L-shaped coil side bracket having one end connected to said external surface of said engine, wherein the other ends of said first and third coil side brackets are located adjacent to and confront the other ends of said second and fourth engine side brackets, respectively, thereby defining first and second gaps therebetween, and first and second layers formed of a resilient elastomer with a low heat conductivity and a high temperature resistance for bridging said first and second gaps, respectively.

2. An ignition coil device attaching construction as defined by claim 1, wherein said other ends of said first and third coil side brackets are located on the outside of said second and fourth engine side brackets, respectively.

3. An ignition coil device attaching construction according to claim 1, wherein the ignition coil device comprises a core comprising a plurality of thin plates of ferrous material, and a plurality of core assembling screws which clamp together said thin plates, said core assembling screws also attaching said one ends of said first and third coil side brackets to said ferrous core.

4. An ignition coil device attaching construction according to any of claims 1, 2 or 3, wherein said layers are formed of butadiene rubber.

5. An ignition coil device attaching construction according to any of claims 1, 2 or 3, wherein said layers are formed of styrene butadiene rubber.

6. An ignition coil device attaching construction according to any of claims 1, 2 or 3, wherein said layers are formed of acrylonitrile butadiene rubber.

7. An ignition coil device attaching construction according to any of claims 1, 2 or 3, wherein said layers are formed of isobutylene isoprene rubber.

8. An ignition coil device attaching construction according to any of claims 1, 2 or 3, wherein said layers are formed of ethylene propylene rubber.

9. An ignition coil device attaching construction according to any of claims 1, 2 or 3, wherein said layers are electrically insulating.

* * * * *